United States Patent [19]

Hart et al.

[11] 4,071,155

[45] Jan. 31, 1978

[54] PINCER BUCKET

[76] Inventors: Samuel A. Hart, 720 Anderson Road, Davis, Calif. 95616; William E. Hart, P.O. Box 1734, Fort Collins, Colo. 80522

[21] Appl. No.: 687,360

[22] Filed: May 17, 1976

[51] Int. Cl.[2] ..... B66C 3/02

[52] U.S. Cl. ..... 214/147 G; 37/187; 214/656; 294/88

[58] Field of Search ..... 37/183–188, 37/117.5, 118, 141; 214/147 R, 147 G, 656, 657; 294/70, 71, 88

[56] References Cited

U.S. PATENT DOCUMENTS

| | | | |
|---|---|---|---|
| 2,437,572 | 3/1948 | Walter | 37/187 |
| 2,470,779 | 5/1949 | Lankovski et al. | 37/118 A X |
| 2,636,648 | 4/1953 | Richardson | 294/71 X |
| 2,949,201 | 8/1960 | MacAlpine et al. | 214/657 |
| 3,097,875 | 7/1963 | Kaplan | 294/88 X |
| 3,410,431 | 11/1968 | Viu | 294/88 X |
| 3,627,371 | 12/1971 | Billings | 37/187 R X |
| 3,693,274 | 9/1972 | Piccagli | 37/187 |
| 3,920,137 | 11/1975 | McCain | 37/187 X |
| 3,929,366 | 12/1975 | Keverline | 214/653 X |

FOREIGN PATENT DOCUMENTS

| | | | |
|---|---|---|---|
| 987,466 | 4/1951 | France | 214/147 R |

*Primary Examiner*—Frank E. Werner
*Attorney, Agent, or Firm*—Lothrop & West

[57] ABSTRACT

Two pincer bucket halves, each including a horizontal blade, are mounted on a frame for opposed pivotal movement in a normally horizontal plane about respective parallel normally vertical axes. An upstanding back spans the axes and upstanding sides extend perpendicularly from the outer edges of the pincer blades. To pick up material, such as a pile of leaves or branches, from a ground surface, the pincer bucket halves are opened and advanced toward the pile with the opposed blades in contact with the ground surface. After the bucket halves are located on opposite sides of the pile, the bucket halves are brought together so that the blades are closed, thereby undercutting and supporting the material, with the vertical sides of the buckets confining the material in combination with the vertical back. The embraced material may then be elevated and transported within the bucket. The material is discharged by tilting the bucket forwardly and opening the bucket halves. As a modification, the two bucket halves may be pivoted about a single vertical axis.

5 Claims, 8 Drawing Figures

22
10
11
21
52
26
51
12
50

25
10
11
22
26
53
12
50

FIG-3
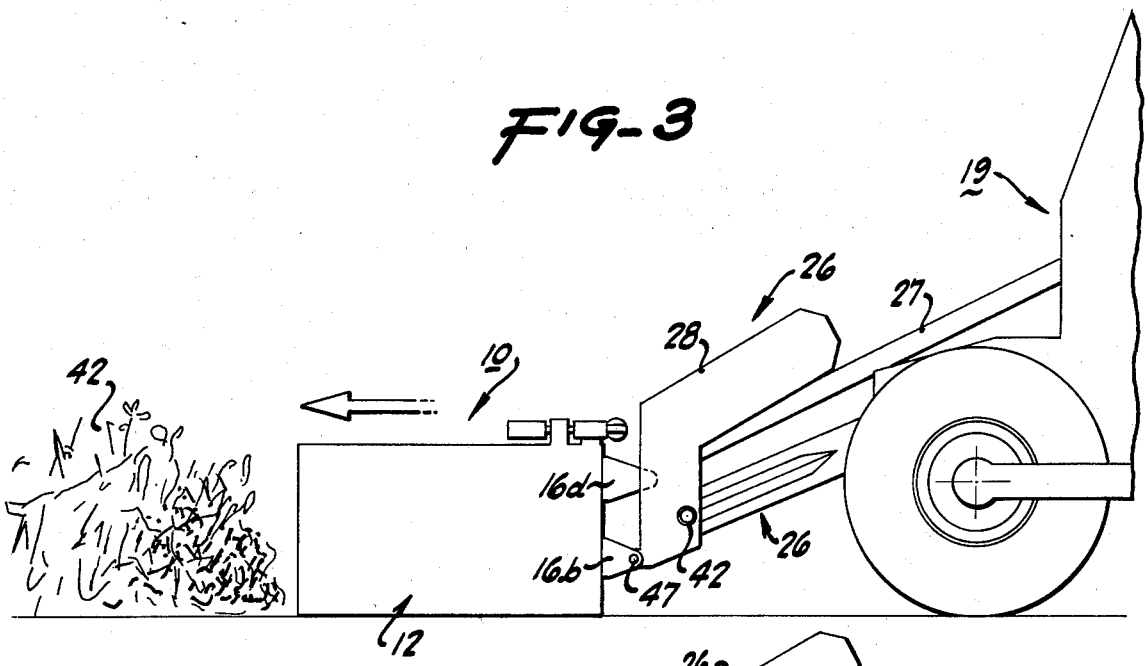
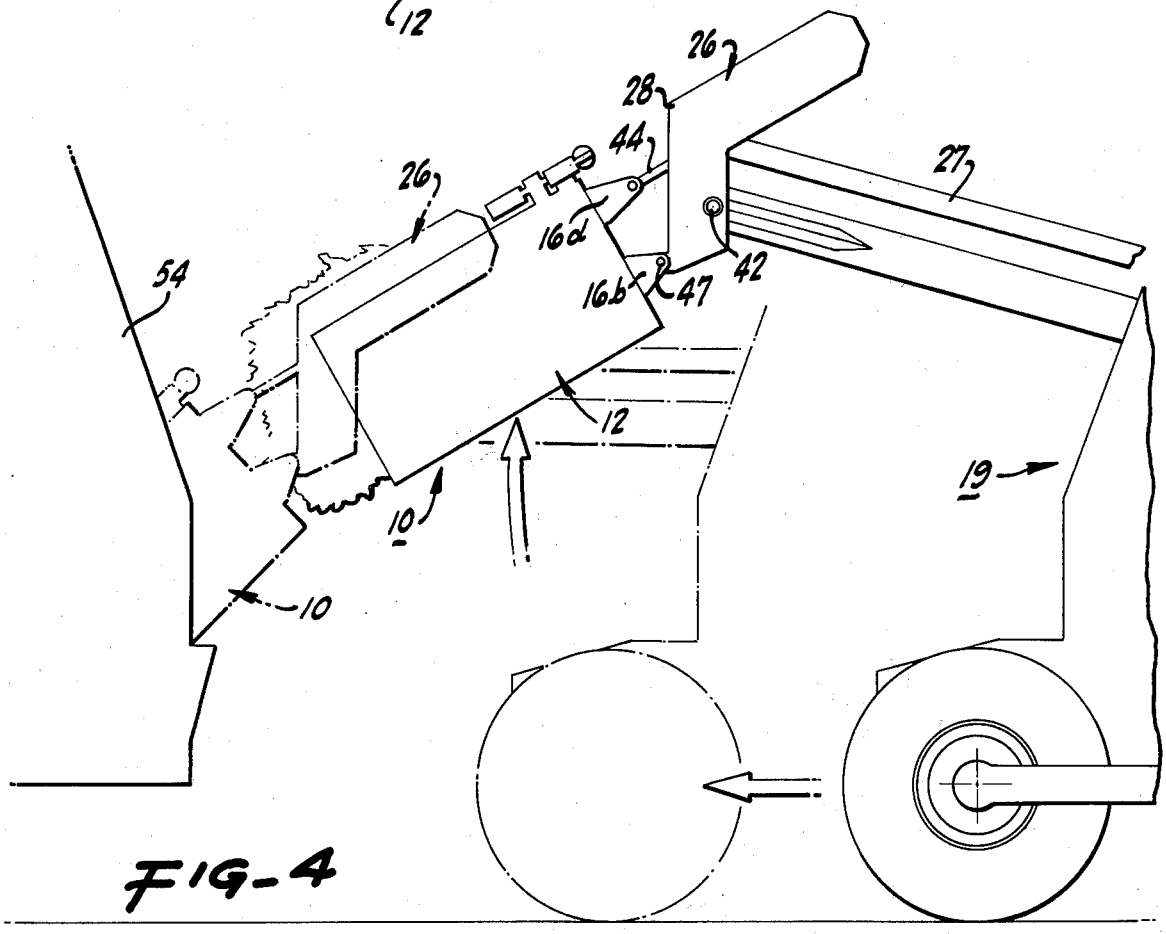
FIG-4

PINCER BUCKET

BACKGROUND OF THE INVENTION

Bucket loaders have been known and used for many years. The customary non-articulated bucket addresses a pile of material from the front. The inertia and resistance of a large or heavy pile enables the front edge of the bucket to undercut a portion of the material provided the bucket is advanced with sufficient speed. Then, when the bucket is tilted upwardly the bucket is filled. With a small or light pile of material, on the other hand, the resistance of the pile to the force of the entering, undercutting blade is insufficient, and the small pile retreats from the advancing blade. A backstop of some kind is therefore needed when a conventional bucket is used to pick up small piles. The backstop often consists of a broom held firmly against the advancing bucket and pile. Labor cost is thereby incurred.

Articulated buckets with opposing-action bucket halves are also well known. The clamshell bucket is a common example.

In the classical clamshell, the material-entering edge of each bucket half is parallel to the pivotal axis as the edge sweeps through an arcuate path. This is exemplified in the devices of R. T. MacAlpine et al U.S. Pat. No. 2,949,201 and P. E. La Tendresse U.S. Pat. No. 2,788,143. Owing to the fact that the entering edges of the bucket halves in these patents sweep in an arcuate manner, with foward components of motion, it is necessary that the material being loaded be restrained in some manner from moving away from the advancing cutting edges.

Where, as in Mac Alpine, the material is located in situ on the face of a mine shaft, there is no problem since the mass is stationary. In the usual case, however, the mass is not so located and some kind of restraint is necessary. This is why the axis of a clamshell bucket is often horizontal and elevated above the material being addressed, the underlying ground serving to prevent the material from moving away from the bucket halves, as in the La Tendresse disclosure.

SUMMARY OF THE INVENTION

The present invention relates to an improved pincer bucket which is particularly useful in connection with a standard front-end loader to pick up material, such as a pile of leaves and branches, from a ground surface, and to convey the material to a desired location.

The pincer bucket disclosed herein utilizes a construction and operation which differ from prior art bucket loaders in that the material is picked up by opposed flat pincer blades which move in transverse slidable contact with the ground surface to undercut the material and deposit it on the upper faces of the blades. The blades are uniquely constructed and operated so that the material is loaded upwardly rather than moved ahead of the advancing pincer blades as the blades close. In other words, the undercutting forces of the two bucket halves are applied at such angles to each other that the resulting force vector of the sum is less than the frictional force vector occurring between the pile and the underlying surface on which the pile rests. The pile therefore remains stationary as the bucket halves close upon and undercut the pile, thereby repositioning the material on top of the pincer blades so that when the jaws close the material is securely encompassed not only on the sides but also from below.

It is an object of the present invention to provide a pincer bucket which overcomes the drawbacks of the prior art and is particularly effective to pick up a variety of material, such as leaves and tree prunings from a ground surface.

It is another object of the invention to provide a pincer bucket which can be operated by one person and does not require an external backstop such as a hand-held broom, shovel, or the like in order to pick up small piles or piles of lightweight material.

It is a further object to provide a pincer bucket which is attachable to most commercial types of loaders and which is rugged, long-lived and relatively maintenance free.

It is another object of the invention to provide a generally improved bucket loader.

Other objects, together with the foregoing, are attained in the embodiment described in the following description and illustrated in the accompanying drawings.

BRIEF DESCRIPTION OF THE DRAWINGS

FIG. 3 is a side elevational view of the pincer bucket approaching the pile for loading, corresponding to the position of the bucket shown in broken line in FIG. 1;

FIG. 4 is a side elevational view of the pincer bucket elevating and unloading the pile into a refuse receptacle by tilting the bucket forwardly and downwardly, followed by opening the bucket halves;

DESCRIPTION OF THE PREFERRED EMBODIMENT

Figure 1:
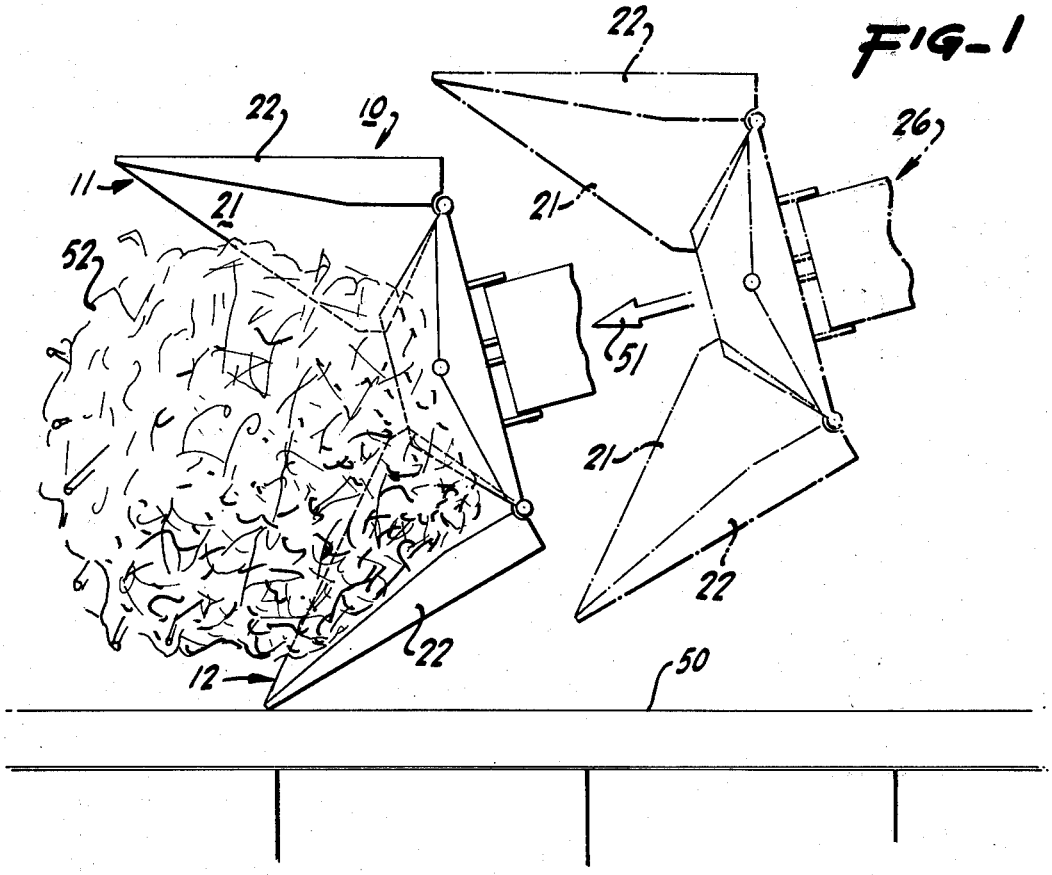
FIG. 1 is a top plan view of a pincer bucket embodying the present invention advancing upon a pile of material located, in this instance, at curbside.

While the pincer bucket of the invention is susceptible of numerous physical embodiments, depending on the environments and requirements of use, substantial numbers of the herein shown and described embodiment have been made, tested, and used, and all have performed in an eminently satisfactory manner.

As appears most clearly in FIGS. 5 through 8, a pincer bucket 10 embodying the invention includes two bucket halves 11 and 12 pivotal about respective vertical shafts 13 and 14, a backplate 15 spanning the two shafts 13 and 14, and a bucket closure mechanism, generally designated by the reference numeral 20. Attachment hinge plates **16*a*, 16*b*, 16*c*, and 16*d* connect the bucket to a conventional front-end loader 19**.

The front end loader 19 can be any one of numerous commercial varieties and includes a forwardly extending boom, generally designated by reference numeral 26, preferably with a parallel linkage structure 27 to hold a forward frame 28 in vertical attitude regardless of boom posture and thereby provide easy and accurate maneuverability of the pincer bucket 10.

The lower outer hinge plates 16*a* and 16*b* are pivotally connected to the lower end of the forward frame 28 and the upper inner hinge plates 16*c* and 16*d* are pivotally mounted on the forward end of the plunger of a hydraulic cylinder 43, as will subsequently be explained in more detail.

Figure 7:
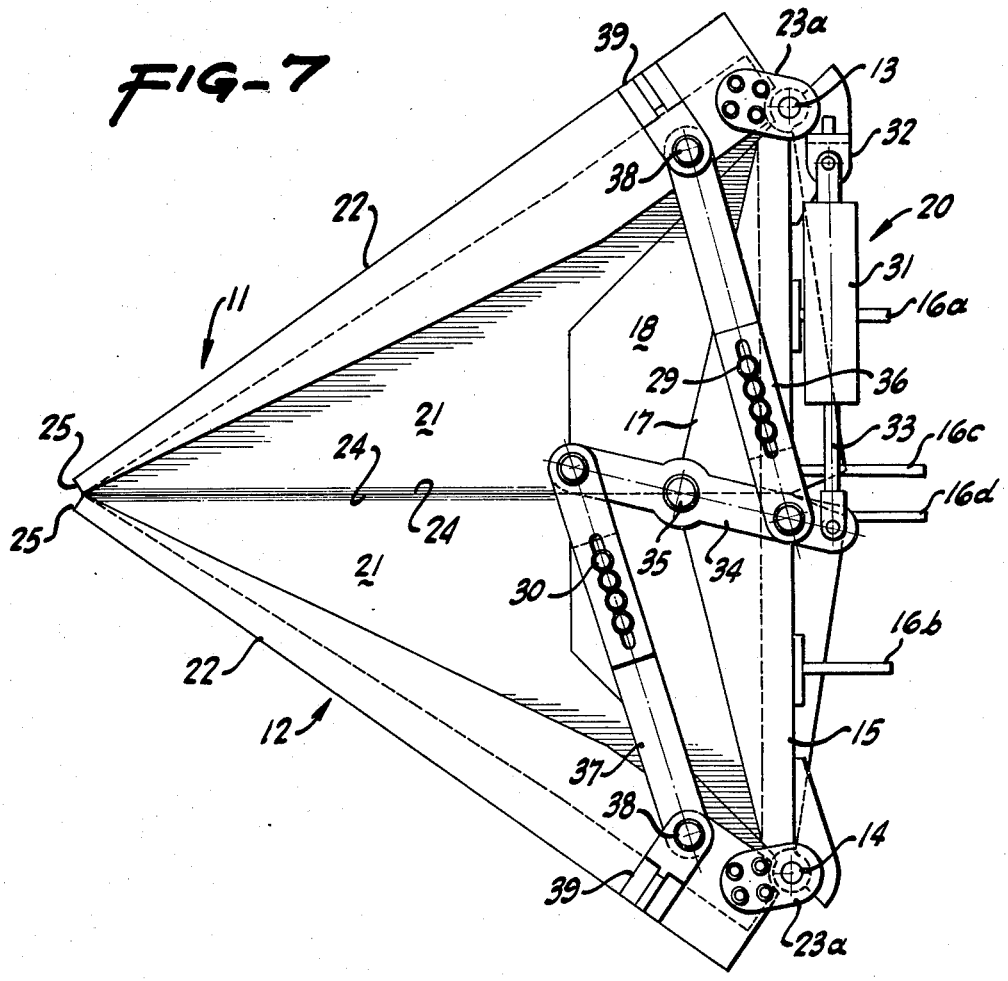
FIG. 7 is a top plan view of the pincer bucket, to an enlarged scale, showing the bucket in closed position; and, FIG. 8 is a front elevational view of the pincer bucket to an enlarged scale, with the bucket in an open position, corresponding to FIGS. 5 and 6.
Figure 8:
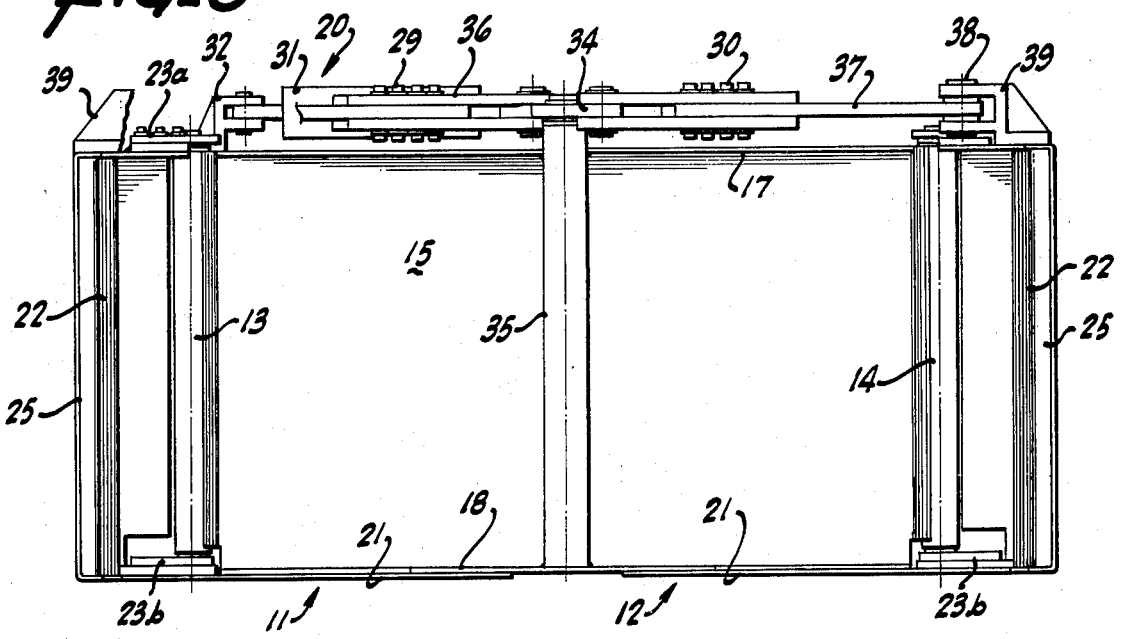

Each of the bucket halves 11 and 12 includes a generally triangular, normally-horizontal bottom plate 21 with an upstanding outside wall 22 of hollow, double thickness construction to which is attached a pair of vertically spaced hinge plates 23*a* and 23*b* for pivotally connecting the bucket halves to shafts 13 and 14. The facing cutting edges 24 of the bottom plates 21 are preferably beveled to enhance the undercutting action, and when the bucket is in closed position, as indicated in FIG. 7, the two cutting edges 24 are contiguous and prevent the spillage of material from the bucket. As can most clearly be seen in FIG. 5, the vertical pivot shafts 13 and 14 are located at the vertices of the triangular bottom plates 21 opposite the respective facing cutting edges 24. The vertical front edges 25 of the upstanding walls 22 are also contiguous when the bucket halves are in closed position, as shown in FIG. 7. This enables the bucket to grasp and hold long material not completely fitting into the bucket.

The bucket backplate 15, also of spaced double wall thickness, carries the hinge shafts, 13 and 14, the shafts 13 and 14 being attached to the outer ends of the backplate. Upper and lower horizontal triangular plates 17 and 18, respectively, extend forwardly from the backplate 15. The purpose of plates 17 and 18 is to support the closure mechanism shaft 35. Attachment hingepoints 16*a*, 16*b*, 16*c*, and 16*d* are located on the backside of the backplate 15 and connect the bucket 10 to the loader 19, as previously explained.

Figure 5:
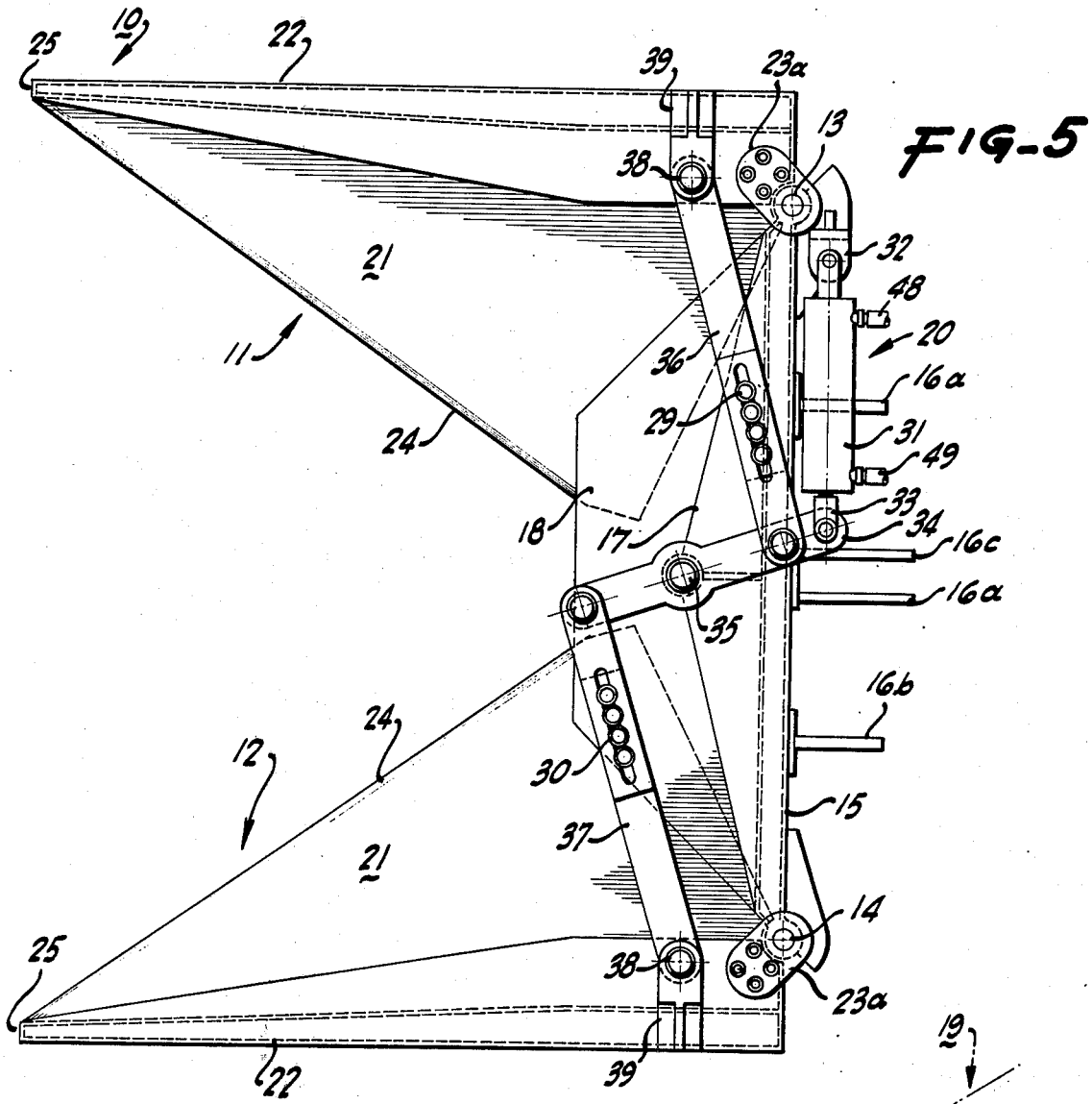
FIG. 5 is a top plan view of the pincer bucket, to an enlarged scale, showing the bucket in an open position.

The bucket opening and closing mechanism 20 comprises a hydraulic cylinder 31, one end of which is pivotally mounted on a bracket 32 welded to the bucket backplate 15. The hydraulic cylinder piston shaft 33 attaches to a crank arm 34 which is mounted on and rotates in unison with a vertical pivot shaft 35, the shaft 35 being parallel to shafts 13 and 14. Crank arm 34 actuates connecting rods 36 and 37 pivotally attached at their outer ends to respective bucket halves 11 and 12 by connector pins 38 carried on brackets 39 welded to the upstanding walls 22. The length adjustment bolts 29 and 30 of connecting rods 36 and 37, respectively, are useful in keeping the bucket cutting edges 24 contiguous in the closed position. A comparison of FIGS. 5 and 7 shows the articulation given to bucket halves 11 and 12 by the extension and contraction of hydraulic piston 33. The two bucket halves 11 and 12 move from open to closed position as the plunger 33 projects from the cylinder 31 and vice versa.

Figure 6:
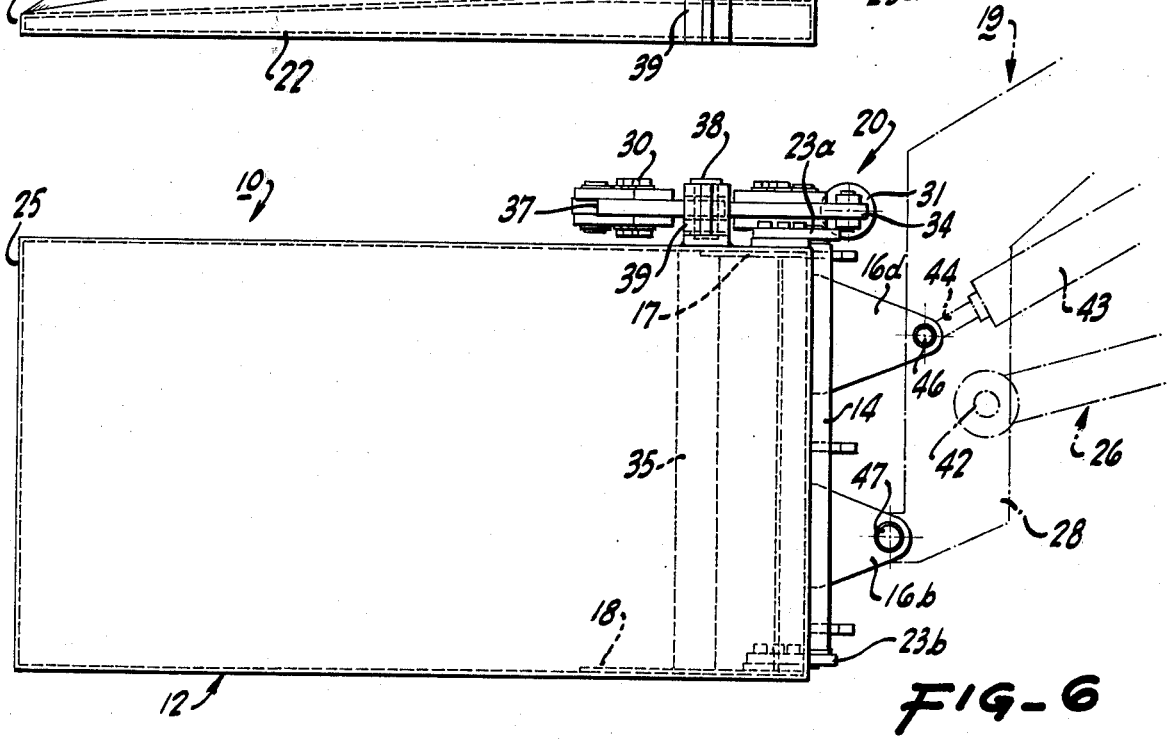
FIG. 6 is a side elevational view of the pincer bucket to an enlarged scale, showing the bucket in an open position, corresponding to FIG. 5.

As previously indicated and as most clearly appears in FIG. 6, the bucket 10 is attached to the forward frame 28 of the front end loader at hinge-points 16*a*, 16*b*, 16*c*, and 16*d*. In a conventional loader mechanism 41 the boom 26 is pivotally mounted on the frame 28 at a lower pivot point 42 and an elevated hydraulic cylinder 43 actuates a plunger 44 pivotally connected at its forward end to the hinge points 16*c* and 16*d* by pivot pin 46. By projecting the plunger 44 the bucket 10 is tipped forwardly and downwardly about the pivot pins 47 in the hinge plates 16*a* and 16*b* as clearly appears in the two positions of the boom and bucket illustrated in FIGS. 3 and 4.

The standard bucket loader has two hydraulic circuits; one to raise and lower the boom carrying the bucket, and one to tilt the bucket forwardly for emptying and back for loading and material transport. The pincer bucket requires a third hydraulic circuit to actuate hydraulic cylinder 31 through fittings 48 and 49.

Many modifications are possible within the scope of the invention. For example, the pincer blades 21 of the bucket halves 11 and 12 could be disposed in closely adjacent parallel planes so that one of the blades passes under the other in the manner of a pair of scissors. In the preferred embodiment shown, however, the two planes coincide and the two opposed beveled blades 24 abut when closed.

The locations of the pivot shafts 13 and 14 may also differ substantially from the locations shown; in fact, the bucket halves 11 and 12 could be hinged at a central shaft such as at 35. The single hydraulic cylinder 31 and crankarm 34, although operable in a highly satisfactory manner, could be replaced by any other appropriate mechanism comprising, for example, two hydraulic jacks connected between the central shaft 35 and the bucket walls 22.

Figure 2:
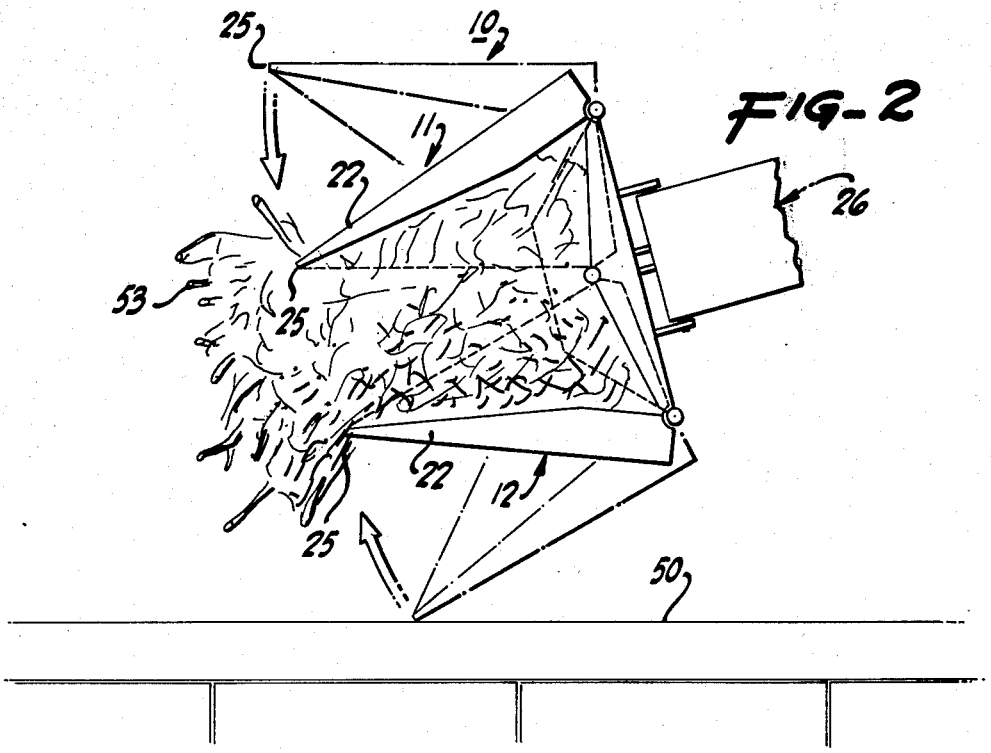
FIG. 2 is similar to FIG. 1 but with the pincer bucket closing so as to undercut and embrace the pile and place it on top of the horizontal pincer blades while the upstanding side walls laterally contain and squeeze the embraced and undercut pile.

In addition to effectively picking up material without an external backstop, the pincer bucket is able cleanly to pick up material close to a curb, as previously described and as shown in the sequential positions illustrated in FIGS. 1 and 2. The pincer bucket of the invention is also capable of grasping materials longer than will fit into the bucket. Thus, after moving forwardly at an angle toward the curb 50 in the direction of the arrow 51, the bucket embraces the pile of material 52 from both sides and from below. Even though some of the pile consists of long branches 53, the strong squeeze applied by the bucket halves and, more particularly, the vertical leading edges 25 of the side walls 22 tightly clamps the branches and holds them during transport to the refuse disposal receptacle 54, as appears in FIG. 4.

It can therefore be seen that we have provided a pincer bucket which is not only versatile in being able to load and transport piles consisting of a variety of materials, but which can expeditiously accomplish clean removal along a sidewall or curb, as well as from unobstructed ground or paved surfaces.

What is claimed is:

1. A pincer bucket comprising:

a. first and second pincer bucket halves mounted for relative pivotal movement about at least one vertical axis at the rear thereof;

b. generally planar upstanding side walls mounted on each of said pincer bucket halves, said side walls extending forwardly to define a generally rectilinear area therebetween when said halves are in open position and being movable to a position where their leading edges are in close juxtaposition when said halves are in closed position;

c. a substantially planar horizontal pincer blade of generally triangular configuration extending inwardly from each of said walls to form a partial bottom for said pincer bucket when said halves are in open position, said pincer blades moving into at least closely adjacent position when said halves are moved to closed position and therefore being adapted to undercut a pile of freestanding material on a substantially horizontal surface as said blades are closed with their bottom surfaces closely adjacent said horizontal surface;

d. means for opening and closing said pincer bucket halves; and e. means for moving said pincer bucket forward in open position with said pincer blades disposed generally horizontally and closely above said horizontal surface; whereby major portions of said freestanding material are collected above the blades.

2. A pincer bucket as in claim 1 wherein said pincer blades are pivotally mounted on first and second parallel pivot axes, respectively, and wherein each of said blades extends longitudinally between a first end adjacent the respective pivot axis and a second end remote therefrom and wherein said first and second wall means are also mounted longitudinally on said pincer blades so that the adjacent ends of said wall means remote from the pivot axes are capable of exerting a grasping force on material interposed between said adjacent ends of said wall means in said second position of said blades.

3. A pincer bucket as in claim 1 including means for pivoting said bucket about a transverse axis; and wherein the means for moving includes means for elevating said bucket.

4. A pincer bucket as in claim 3 including a vertical wall extending between said parallel axes; and wherein said bucket pivoting means and said bucket elevating means are connected to said vertical wall.

5. A pincer bucket as in claim 4 wherein said vertical wall spans the ends of said wall means adjacent said axes.

* * * * *